US011759843B2

(12) United States Patent
Obayashi et al.

(10) Patent No.: US 11,759,843 B2
(45) Date of Patent: Sep. 19, 2023

(54) SPRING FORMING MACHINE

(71) Applicant: ASAHI-SEIKI MANUFACTURING CO., LTD., Owariasahi (JP)

(72) Inventors: Eiji Obayashi, Nagoya (JP); Ryota Fukatsu, Owariasahi (JP)

(73) Assignee: ASAHI-SEIKI MANUFACTURING CO., LTD., Owariasahi (JP)

( * ) Notice: Subject to any disclaimer, the term of this patent is extended or adjusted under 35 U.S.C. 154(b) by 0 days.

(21) Appl. No.: 17/668,923

(22) Filed: Feb. 10, 2022

(65) Prior Publication Data

US 2022/0314301 A1 Oct. 6, 2022

(30) Foreign Application Priority Data

Mar. 30, 2021 (JP) ..... 2021-056575

(51) Int. Cl.
*B21F 3/02* (2006.01)
*B21F 11/00* (2006.01)
(Continued)

(52) U.S. Cl.
CPC ..... *B21F 3/02* (2013.01); *B21F 11/005* (2013.01); *B21F 23/00* (2013.01); *B21F 35/00* (2013.01)

(58) Field of Classification Search
CPC .. B21F 3/02; B21F 3/04; B21F 11/005; B21F 23/00; B21F 35/00; H02P 8/40
(Continued)

(56) References Cited

U.S. PATENT DOCUMENTS 5,816,091 A * 10/1998 Sautter ..... B21F 11/00 72/129
5,875,666 A 3/1999 Iltaya
(Continued)

FOREIGN PATENT DOCUMENTS

CN 110729928 A * 1/2020 ..... H02P 8/24
DE 40 40 659 C1 2/1992
(Continued)

OTHER PUBLICATIONS

English translate (JP5268162B2), retrieved date Feb. 9, 2023.*
(Continued)

*Primary Examiner* — Matthew Katcoff
*Assistant Examiner* — Mohammed S. Alawadi
(74) *Attorney, Agent, or Firm* — Oliff PLC

(57) ABSTRACT

A spring forming machine includes: a forming tool slide mechanism including a slider with a forming tool; a first lifting mechanism including a slider with a pitch tool; a second lifting mechanism including a slider with a cutting tool; a fixing base to which the wire feeder and the forming tool slide mechanism are attached; a lifting base to which the cored bar, the first lifting mechanism, and the second lifting mechanism are attached; a plurality of servo motors serving as drive sources; a controller controlling the servo motors; an individual drive control unit individually driving the servo motors; and an interlocking control unit that, when the servo motor of the lifting base is individually operated, interlocks the servo motors of the lifting base and the first lifting mechanism and, when the servo motor of the first lifting mechanism is individually operated, does not interlock the servo motors thereof.

3 Claims, 9 Drawing Sheets

(51) Int. Cl.

| | |
|---|---|
| ***B21F 23/00*** | (2006.01) |
| ***B21F 35/00*** | (2006.01) |
| ***B21F 3/04*** | (2006.01) |
| ***H02P 8/40*** | (2006.01) |

(58) Field of Classification Search
USPC ..... 318/560, 567, 625
See application file for complete search history.

(56) References Cited

U.S. PATENT DOCUMENTS

| | | | | |
|---|---|---|---|---|
| 6,384,561 | B1 * | 5/2002 | Niizuma | B30B 15/148 318/563 |
| 2009/0173126 | A1 * | 7/2009 | Tsuritani | B21F 3/02 72/135 |
| 2013/0036783 | A1 * | 2/2013 | Ookubo | B21F 35/00 72/138 |
| 2014/0311204 | A1 * | 10/2014 | Sigg | B21F 35/00 72/139 |

FOREIGN PATENT DOCUMENTS

| | | | | |
|---|---|---|---|---|
| JP | H07-115101 | B2 | | 12/1995 |
| JP | 2812432 | B2 | | 10/1998 |
| JP | 2001-300673 | A | | 10/2001 |
| JP | 3641561 | B2 | | 4/2005 |
| JP | 5268162 | B2 | * | 8/2013 |
| JP | 5268162 | B2 | | 8/2013 |

OTHER PUBLICATIONS

English translate (CN110729928A), retrieved date Feb. 9, 2023.*
Linear Actuator_What Is It_ How Does It Work; retrieved date Feb. 10, 2023. https://www.iqsdirectory.com/articles/linear-actuator.html.*
AC Servo Sliders _ SMC Corporation of America; retrieved date Feb. 10, 2023. https://www.smcusa.com/products/electric-actuators/AC-Servo-Sliders~125698.*
Aug. 24, 2022 Search Report issued in European Patent Application No. 22158071.5.

* cited by examiner

SPRING FORMING MACHINE

BACKGROUND OF THE INVENTION

(1) Field of the Invention

The present disclosure relates to a spring forming machine that brings a wire fed from a wire feeder into contact with a forming tool to form a coil spring surrounding a cored bar.

(2) Description of Related Art

Conventionally, as this type of spring forming machine, there has been known a spring forming machine in which a lifting base that supports a cored bar is liftably attached to a fixing base to which a slide mechanism that supports a forming tool and a wire feeder are attached. In addition, in this spring forming machine, a pair of lifting mechanisms that support each of a cutting tool for separating the coil spring from the remaining wire and a pitch tool for expanding the space between coils of the coil spring in a liftable manner are also mounted on the lifting base (see JP 2812432 B2 (FIG. 5, paragraphs [0025] and [0053]), for example).

SUMMARY OF THE INVENTION

Incidentally, in a general spring forming machine, positions of movable parts such as a forming tool, a pitch tool, a cutting tool, and a cored bar may be individually adjusted by servo motors that are driving sources of the movable parts. However, in the above-described conventional spring forming machine, when the cored bar is moved by individual adjustment, the pitch tool is also moved accordingly, so that it takes time and effort to perform the individual adjustment. In view of the foregoing, the present disclosure provides a spring forming machine capable of easily performing individual adjustment compared to the conventional technology.

A spring forming machine according to one aspect made to solve the above problem is a spring forming machine in which a wire fed from a wire feeder along a horizontal wire feeding line is brought into contact with a forming tool so as to be formed into a coil spring surrounding a cored bar, a pitch tool for expanding a space between coils of the coil spring is inserted between the coils of the coil spring from one side in a vertical direction with respect to the coil spring, and a cutting tool for separating the coil spring from a remaining wire approaches and separates from the coil spring from an other side in the vertical direction with respect to the coil spring, the spring forming machine including: a forming tool slide mechanism including a slider to which the forming tool is fixed, the slider being supported to be linearly movable in a direction inclined with respect to the wire feeding line; a first lifting mechanism including a slider to which the pitch tool is fixed, the slider being supported to be liftable on one side in the vertical direction with respect to the cored bar; a second lifting mechanism including a slider to which the cutting tool is fixed, the slider being supported to be liftable on the other side in the vertical direction with respect to the cored bar; a fixing base to which the wire feeder and the forming tool slide mechanism are attached; a lifting base that is liftably supported by the fixing base, and to which the cored bar, the first lifting mechanism, and the second lifting mechanism are attached; a plurality of servo motors that are drive sources of the wire feeder, the forming tool slide mechanism, the first lifting mechanism, the second lifting mechanism, and the lifting base; a controller that controls the plurality of servo motors; an individual drive control unit that is provided in the controller and individually drives each of the servo motors corresponding to an operation of an operation unit; and an interlocking control unit that, when the servo motor of the lifting base is individually operated, interlocks the servo motors of the lifting base and the first lifting mechanism so that the slider of the first lifting mechanism is not lifted and lowered with respect to the fixing base by lifting and lowering of the lifting base with respect to the fixing base, and, when the servo motor of the first lifting mechanism is individually operated, does not interlock the servo motors of the lifting base and the first lifting mechanism.

DETAILED DESCRIPTION OF PREFERRED EMBODIMENTS

First Embodiment

Figure 1:
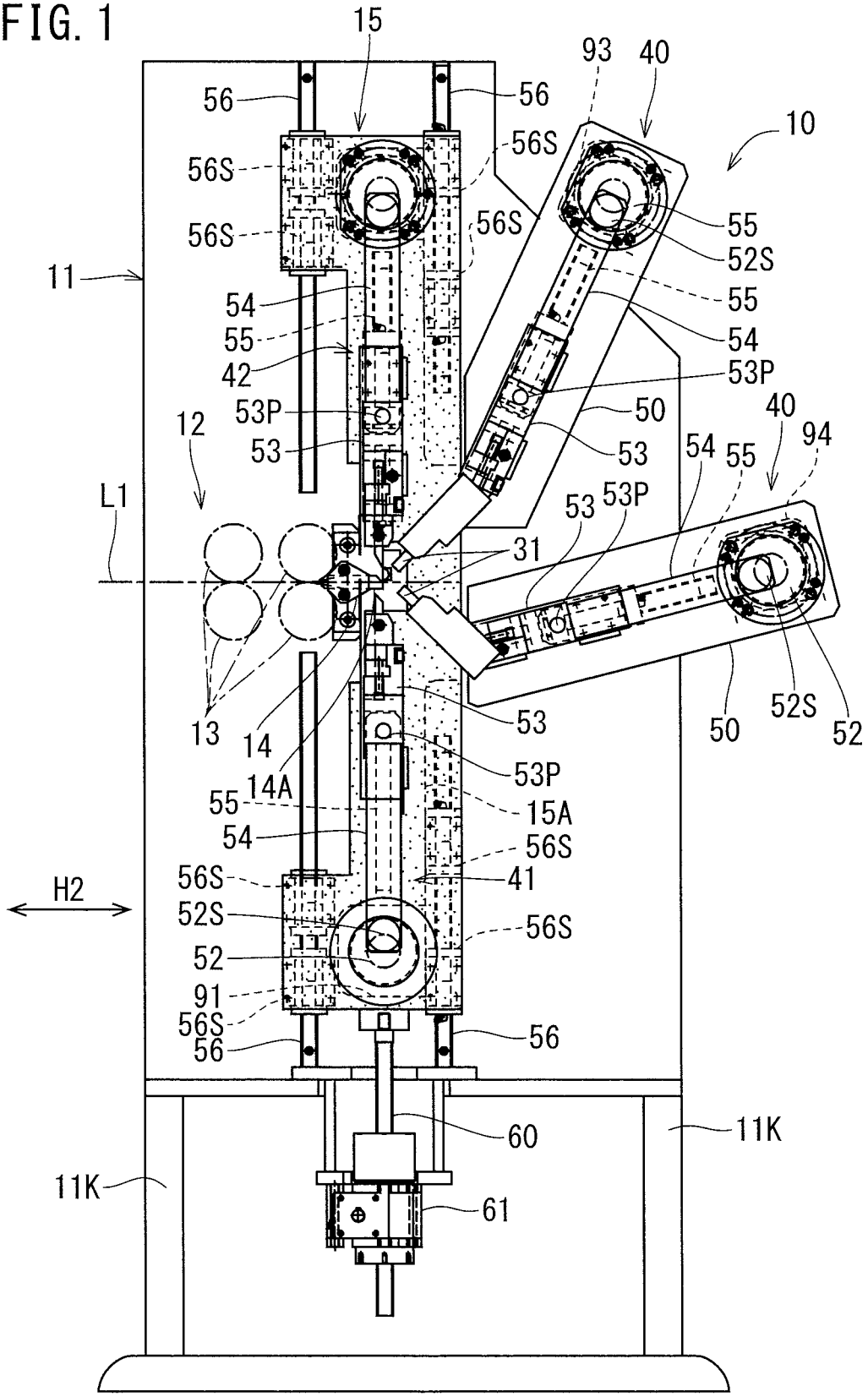
FIG. 1 is a front view of a spring forming machine according to a first embodiment of the present disclosure.

Hereinafter, a spring forming machine 10 according to an embodiment of the present disclosure will be described with reference to FIGS. 1 to 9. As illustrated in FIG. 1, the spring forming machine 10 includes a plate-shaped fixing base 11 that stands vertically. Hereinafter, the horizontal direction, which is the plate thickness direction of the fixing base 11, will be referred to as "front-rear direction H1", the horizontal direction orthogonal thereto will be referred to as "lateral direction H2", "left side when the fixing base 11 is viewed from the front" will be simply referred to as "left", and the opposite side will be simply referred to as "right".

The spring forming machine 10 includes a wire feeder 12 on the left side at the substantially vertical center of the fixing base 11. The wire feeder 12 feeds a wire S (see FIG. 6) along an imaginary wire feeding line L1 extending in the lateral direction H2 in parallel with a front surface of the fixing base 11. The wire feeder 12 includes two pairs of feeding rollers 13 arranged symmetrically above and below the wire feeding line L1. The feeding rollers 13 are each fixed to a front end part of a rotating shaft (not illustrated) penetrating the fixing base 11 in the front-rear direction H1. The rotating shafts are geared behind of the fixing base 11, so that the upper and lower feeding rollers 13 rotate symmetrically. The feeding rollers 13 are rotationally driven by receiving power from a servo motor 90 (see FIG. 7) provided behind of the fixing base 11 through the rotating shafts, and the wire S is fed from the left side to the right side in FIG. 1 along the wire feeding line L1. The feeding amount, feeding speed, and the like of the wire S can be changed as desired by position control by the servo motor 90. Note that the wire S can also be pulled back in the direction opposite to the feeding direction.

Figure 6:
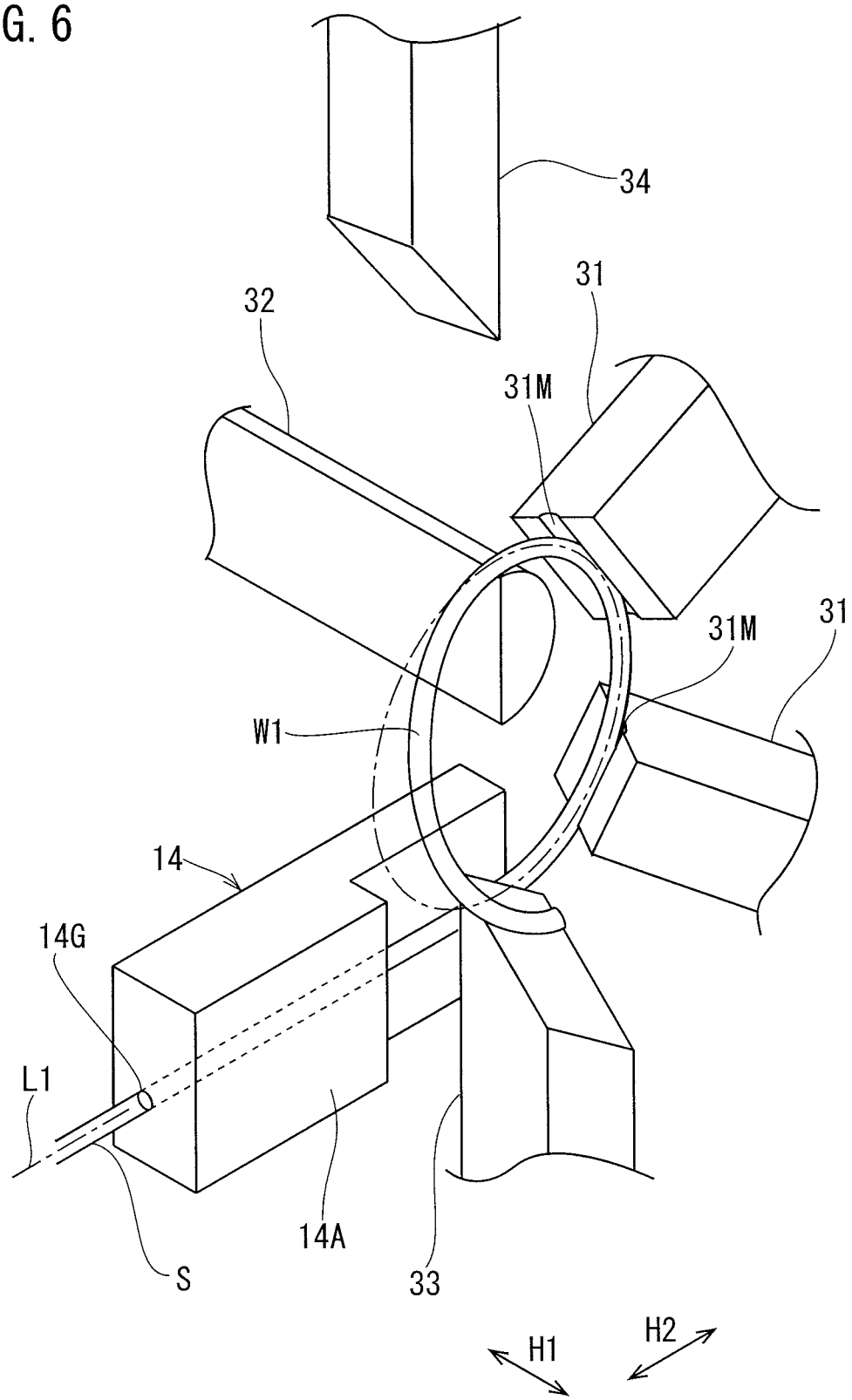
FIG. 6 is a perspective view of a cored bar, a pitch tool, and the like of the spring forming machine.

A guide member 14 is provided on the right of the pair of feeding rollers 13 on the downstream side in the feeding direction. As illustrated in FIG. 6, the guide member 14 includes a quill 14A protruding toward the downstream side in the feeding direction, and a guide hole 14G extending along the wire feeding line L1 penetrates the quill 14A. A pair of forming tools 31 abut on the wire S fed from a tip end part of the quill 14A to form a coil spring W1.

As illustrated in FIG. 6, the pair of forming tools 31 have, for example, a prismatic shape, and extend in directions in which the wire feeding line L1 on the downstream side of one point on the wire feeding line L1 is inclined clockwise and counterclockwise by approximately 45 degrees. A longitudinal groove 31M is formed on a tip end surface of each forming tool 31. The wire S is brought into contact with an inner surface of the longitudinal groove 31M of each forming tool 31 so as to be in sliding contact with the inner surface, whereby the coil spring W1 (FIG. 6 illustrates only part of the coil spring W1) is formed as described above.

As illustrated in FIG. 1, a pair of forming tool slide mechanisms 40 supporting the pair of forming tools 31 are attached to the front surface of the fixing base 11. The pair of forming tool slide mechanisms 40 each include, for example, a band-shaped base plate 50. The pair of base plates 50 are separated vertically, and are fixed to the front surface of the fixing base 11 in an overlapping manner in a posture in which the longitudinal directions of the base plates 50 are inclined with respect to the wire feeding line L1.

One end parts of the base plates 50 on the side far from the wire feeder 12 protrude from the fixing base 11, and servo motors 93 and 94 are attached to the one end parts. A slider 53 that slides in the longitudinal direction is provided on a front surface of each base plate 50, and the forming tool 31 is fixed to each slider 53. The servo motors 93 and 94 and the slider 53 are connected through a crank mechanism, and each forming tool 31 is movable to an any desired position in the longitudinal direction of the base plate 50 (direction inclined with respect to wire feeding line L1) by position control by the servo motors 93 and 94.

In the present embodiment, the power transmission mechanism of the pair of forming tool slide mechanisms 40 to which the forming tools 31 are attached is the same as a first lifting mechanism 41 and a second lifting mechanism 42 to be described later. Hence, the same reference numerals are given except for the reference numerals of the servo motors as the drive sources thereof, and the power transmission mechanism will be described later only with respect to the first lifting mechanism 41. Note that the pair of forming tool slide mechanisms 40 and the later-described first lifting mechanism 41 and second lifting mechanism 42 may be different power transmission mechanisms.

Figure 3:
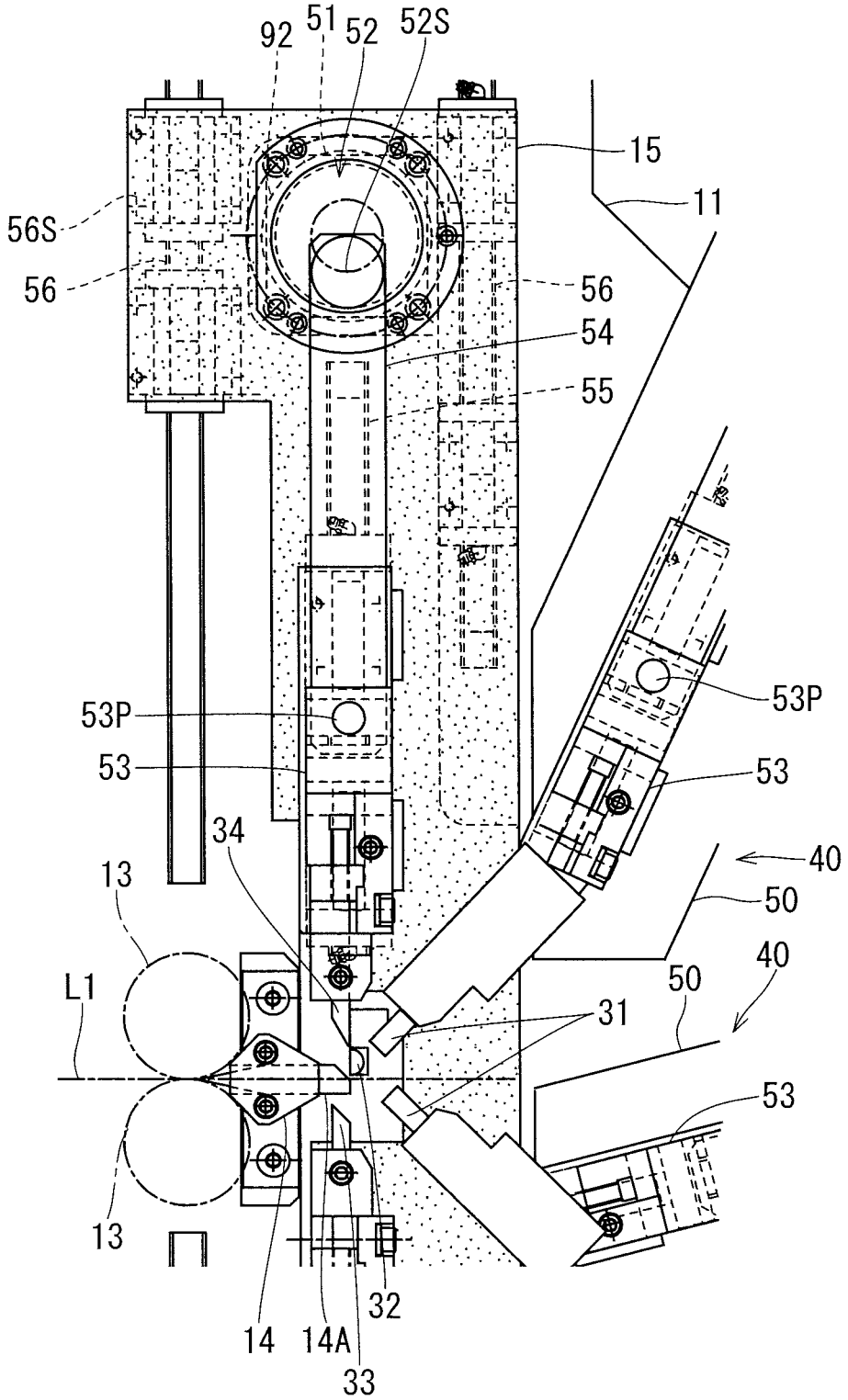
FIG. 3 is a partially enlarged front view of the spring forming machine.

As illustrated in FIG. 3, in order to cut the coil spring W1 from the remaining wire S, a cored bar 32 is disposed inside the coil spring W1, and for example, a cutting tool 34 that cuts the wire S in cooperation with the cored bar 32 is provided above the cored bar 32. For example, a pitch tool 33 for changing as required, the pitch between the coils of the coil spring W1 is provided below the cored bar 32. A mechanism that supports the cored bar 32, the pitch tool 33, and the cutting tool 34 is attached to a lifting base 15 liftably provided on the front surface of the fixing base 11.

As illustrated in FIG. 1, the lifting base 15 has, for example, a plate shape extending in the vertical direction, and is placed on the front surface of the fixing base 11. In order to support the lifting base 15, for example, a pair of guide rails 56 are fixed to the front surface of the fixing base 11 respectively on the upper and lower sides of the wire feeding line L1. The guide rails 56 extend from upper and lower end parts of the fixing base 11 to the vicinity of the vertical center of the fixing base 11, and are disposed, for example, on both sides of a vertical line (not illustrated) passing through a front end part of the quill 14A. On a rear surface at both end parts in the vertical direction of the lifting base 15, sliders 56S fixed to both end parts in the lateral direction H2 are slidably engaged with the guide rails 56.

Figure 5:
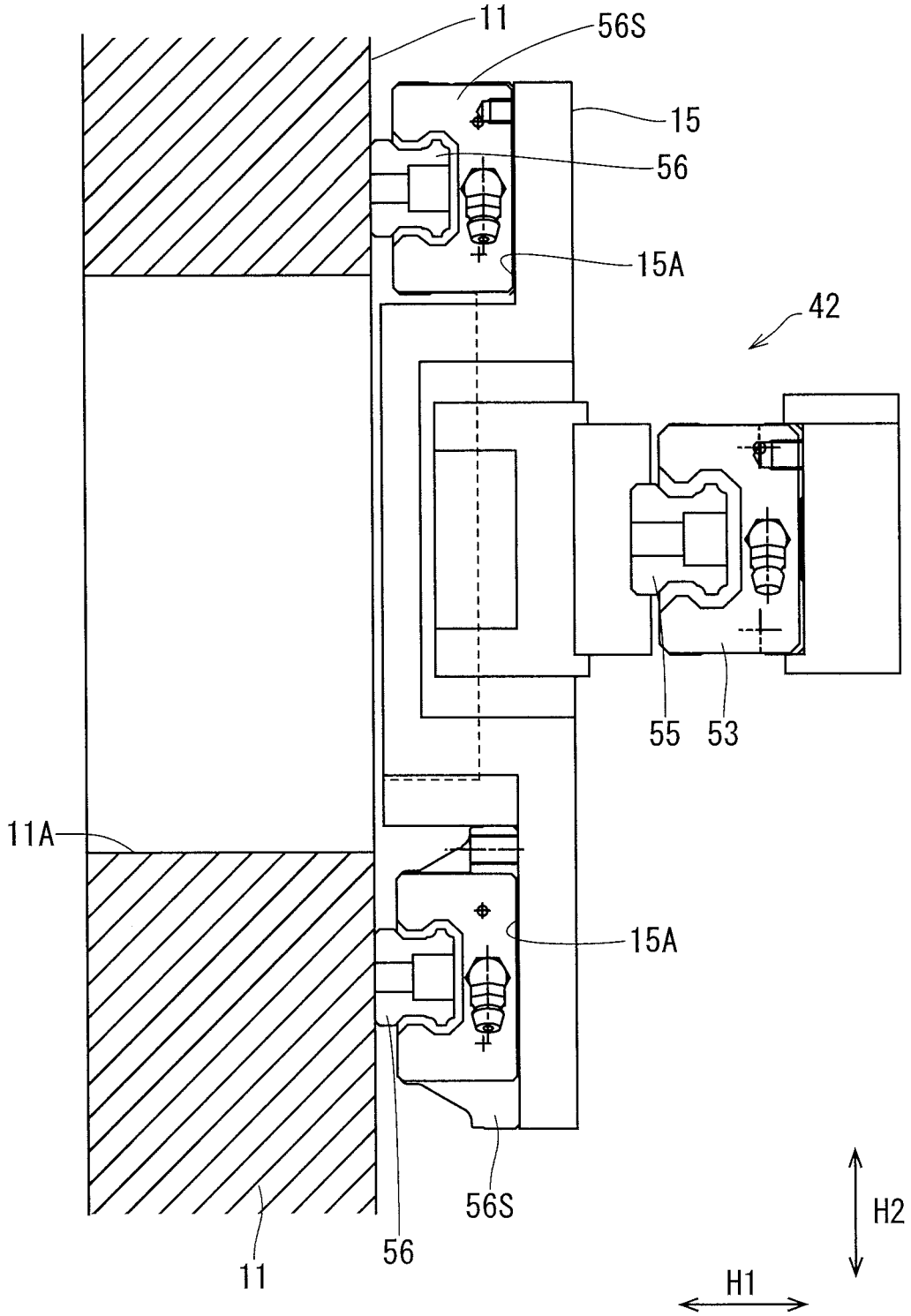
FIG. 5 is a partially enlarged cross-sectional planar view of the lifting base.

Note that an entire left side part of the lifting base 15 except for both end parts in the vertical direction is removed in order to avoid interference with the feeding roller 13 and the guide member 14, for example. As illustrated in FIG. 5, for example, stepped parts 15A extending in the vertical direction are formed to be recessed at both end parts in the lateral direction H2 of the rear surface of the lifting base 15, and the sliders 56S are received in the stepped parts 15A.

Figure 2:
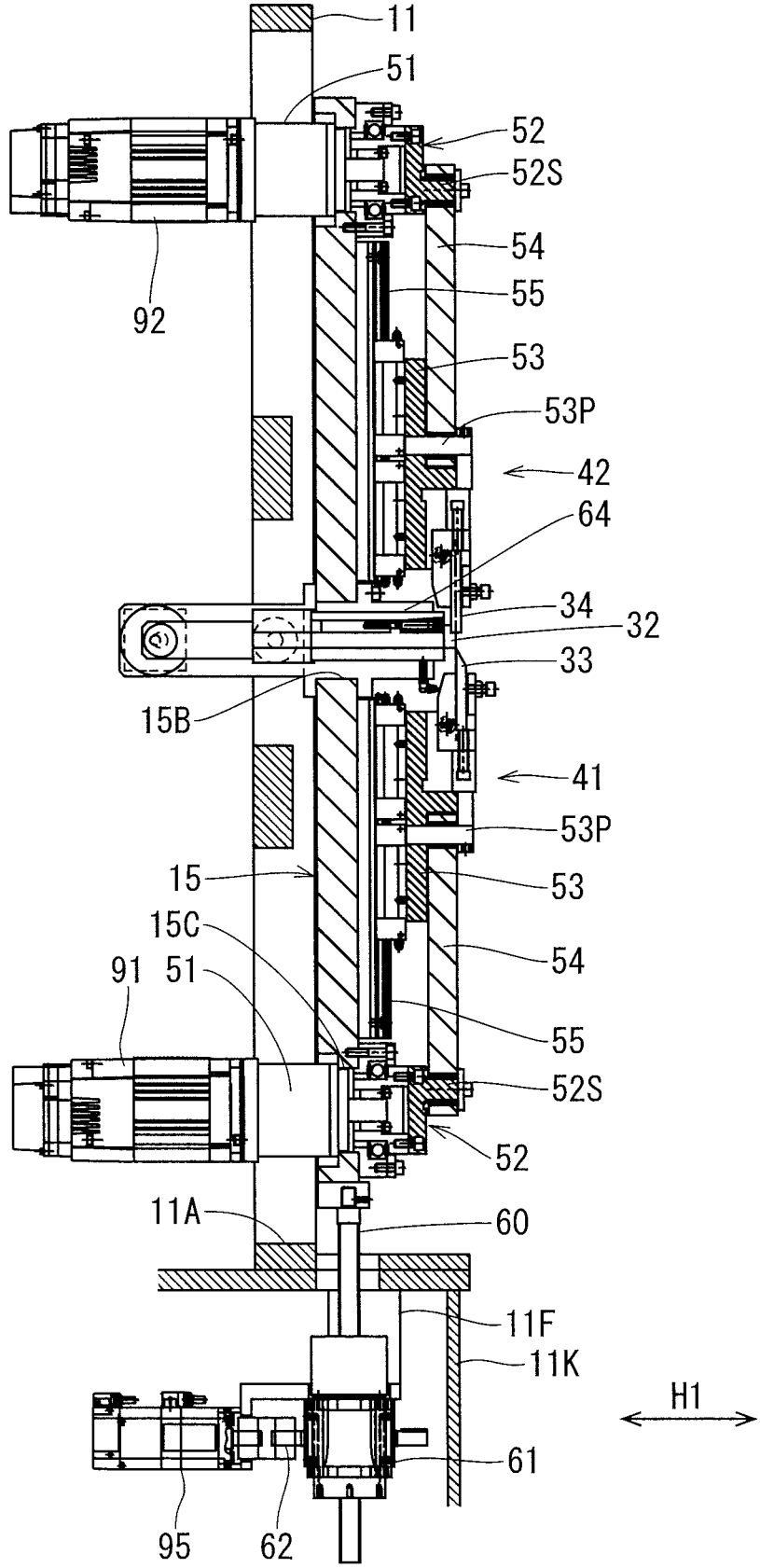
FIG. 2 is a cross-sectional side view of the spring forming machine.

As illustrated in FIG. 1, the fixing base 11 is supported by, for example, a plurality of support legs 11K from below, and a drive unit for lifting and lowering the lifting base 15 is provided in a space below the fixing base 11 formed by the support legs 11K. Specifically, as illustrated in FIG. 2, for example, a ball screw 60 extends downward from a lower end part of the lifting base 15, and a ball nut unit 61 incorporating a ball nut (not illustrated) screwed to the ball screw 60 is fixed to a bracket 11F suspended from the fixing base 11. The ball nut is rotatably supported in the ball nut unit 61, and has a gear part on an outer surface. An end part of a worm gear 62 meshing with the gear part protrudes from the outer surface of the ball nut unit 61, and a rotation output part of a servo motor 95 supported by the bracket 11F is connected thereto. As a result, the lifting base 15 is moved to an any desired position in the vertical direction.

Figure 4:
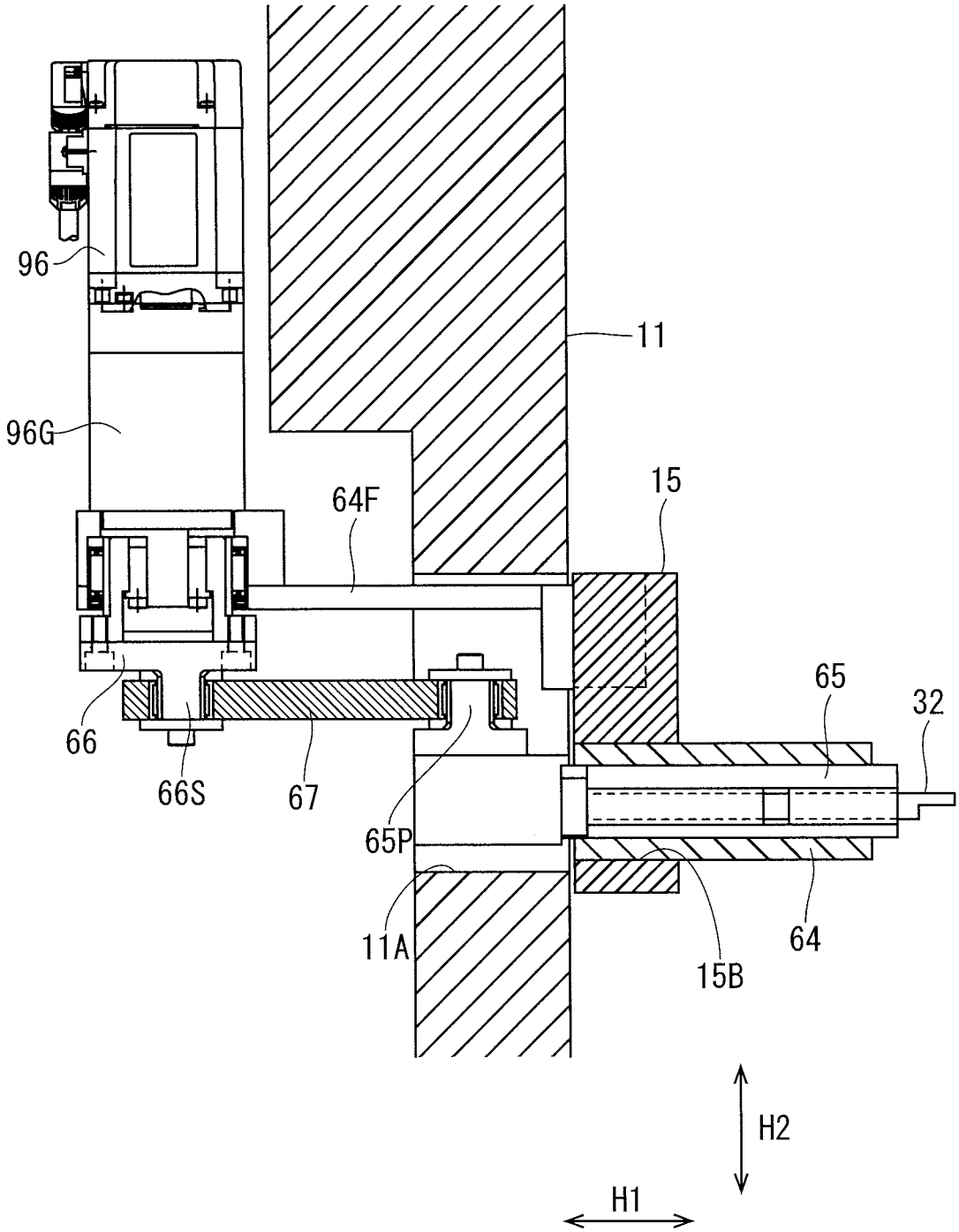
FIG. 4 is a partially enlarged cross-sectional planar view of the spring forming machine.

As illustrated in FIGS. 2 and 4, in a part of the fixing base 11 covered by the lifting base 15 from the front, for example, a long hole 11A penetrating the fixing base 11 in the front-rear direction H1 and extending in the vertical direction is formed. A through hole 15B penetrating in the front-rear direction H1 is formed at the substantially vertical center of the lifting base 15. A support sleeve 64 penetrates the through hole 15B and protrudes frontward from the lifting base 15, and is fixed to the lifting base 15. A slider 65 is accommodated in the support sleeve 64 so as to be movable in the front-rear direction H1, and the cored bar 32 is fixed to the slider 65 and protrudes frontward.

As illustrated in FIG. 4, a rear end part of the slider 65 protrudes, for example, to the rear side of the lifting base 15, and is provided with a pin 65P extending in the lateral direction H2. Furthermore, a bracket 64F protrudes from the rear surface of the lifting base 15 to a position behind the fixing base 11 through the long hole 11A, and a crank member 66 is fixed to a rotation output part of a servo motor 96 with a speed reducer 96G attached to the bracket 64F. A crank shaft 66S provided at a position offset from the rotation center of the crank member 66 and the pin 65P of the slider 65 are connected by a link bar 67 to form a crank mechanism. As a result, the cored bar 32 is movable to an any desired position in the front-rear direction H1 according to position control by the servo motor 96. When the lifting base 15 is driven in the vertical direction by the servo motor 95 as described above, the cored bar 32 is moved to an any desired position in the vertical direction as well. That is, the position of the cored bar 32 is controlled by the servo motors 95 and 96 in the vertical direction and the front-rear direction H1, respectively.

As illustrated in FIG. 2, for example, a through hole 15C penetrates, in the front-rear direction H1, a lower end part of the lifting base 15. A servo motor 91 with a speed reducer 51 is fixed to the lifting base 15 in a state of penetrating the through hole 15C and the long hole 11A. A crank member 52 is fixed to a rotation output part at the front end of the servo motor 91. Further, for example, on the front surface of the lifting base 15, a guide rail 55 extending from a position near the lower end to a position in the vicinity of the lower side of the support sleeve 64 is fixed, and the slider 53 is slidably engaged with the guide rail 55. A pin 53P attached to the slider 53 and a crank shaft 52S provided in a position offset from the rotation center of the crank member 52 are connected by a link bar 54 to form the first lifting mechanism 41 including a crank mechanism.

On the upper side of the support sleeve 64 in the lifting base 15, a second lifting mechanism 42 having the same structure as the first lifting mechanism 41 is provided, for example, symmetrically with the first lifting mechanism 41. The pitch tool 33 is fixed to an upper end part of the slider 53 of the first lifting mechanism 41 and protrudes upward, and the cutting tool 34 is fixed to a lower end part of the slider 53 of the second lifting mechanism 42 and protrudes downward. The pitch tool 33 is movable to an any desired position in the vertical direction by the servo motor 91 which is a drive source of the first lifting mechanism 41, and the cutting tool 34 is movable to an any desired position in the vertical direction by a servo motor 92 which is a drive source of the second lifting mechanism 42.

As illustrated in FIG. 6, the cored bar 32 has, for example, a structure in which a semicircular columnar body having a semicircular cross section extends from the tip end of a prismatic body, and is disposed such that a flat side surface of the semicircular columnar body faces the quill 14A side. The cutting tool 34 has, for example, a shape in which a tip end part of a prism is cut so as to be inclined with respect to the vertical direction. The cutting tool 34 is disposed so that when the cutting tool 34 is lowered, a surface of the cutting tool 34 opposite to the inclined surface overlaps with the flat side surface of the semicircular columnar body of the cored bar 32. As a result, the wire S is sandwiched between the cored bar 32 and the cutting tool 34 to be cut, and the coil spring W1 is cut from the remaining wire S.

The pitch tool 33 has, for example, a structure in which a tip end part of a prism having a rectangular cross section is cut so as to be inclined with respect to the vertical direction, and an edge part along the cut oblique side is cut even further so as to have a wedge-like cross section. In the present embodiment, the pitch tool 33 is disposed, for example, such that its cut inclined surface faces away from the quill 14A. The pitch tool 33 expands the pitch between the coils in the coil spring W1. The pitch is changed according to the amount by which the pitch tool 33 is inserted between the coils of the coil spring W1.

Figure 7:
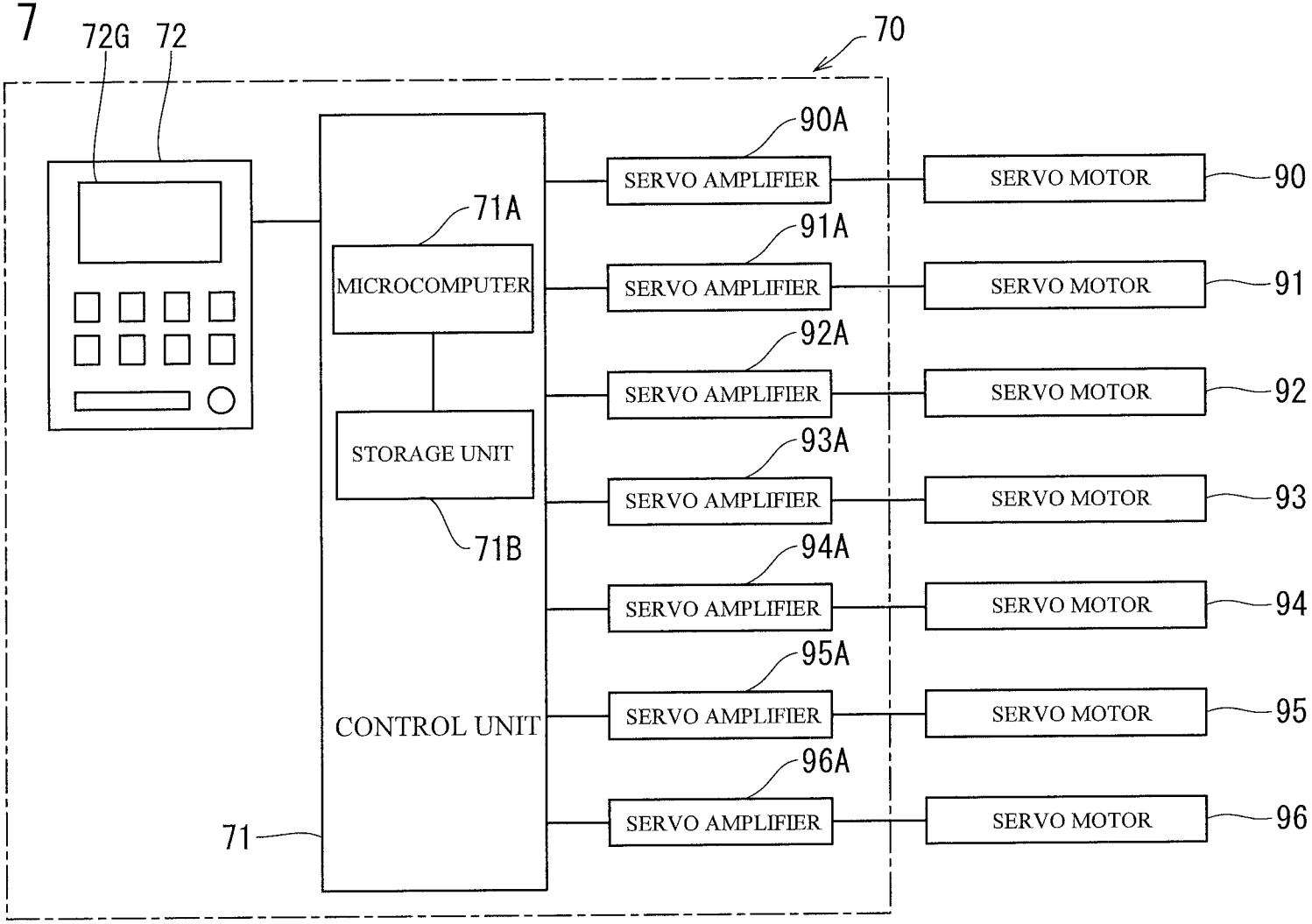
FIG. 7 is a conceptual diagram of a controller.

FIG. 7 conceptually illustrates a controller 70 of the spring forming machine 10. The controller 70 includes servo amplifiers 90A to 96A of the plurality of servo motors 90 to 96 described above, a control unit 71 that gives command values to the servo amplifiers 90A to 96A, and a console 72 connected to the control unit 71. The control unit 71 includes a microcomputer 71A and a storage unit 71B. The storage unit 71B stores a plurality of operation programs for manufacturing a plurality of coil springs W1 having different specifications, and an operation program is executed as required by the microcomputer 71A as a "program execution unit" to form the coil spring W1.

Specifically, each operation program includes, for example, a plurality of pieces of target position data for the servo motors 90 to 96, and the servo motors 90 to 96 are driven so that the positions of the feeding roller 13, the lifting base 15, the forming tool 31, the cored bar 32, the pitch tool 33, and the cutting tool 34 (hereinafter collectively referred to as "forming movable part") change to positions specified by the target position data. The controller 70 is switchable between a continuous operation mode and a manual operation mode, for example. A plurality of coil springs W1 are continuously formed by repeatedly executing an operation program by the microcomputer 71A in the continuous operation mode. The controller 70 can also be set to the manual operation mode to cause the microcomputer 71A to execute an operation program to stop the coil spring W1 in an any desired state while forming.

In the manual operation mode, for example, each servo motor 90 to 96 can be individually operated by the console 72 to create target position data by teaching. That is, when the feeding roller 13, the forming tool 31, the cored bar 32, the pitch tool 33, and the cutting tool 34 are moved to any desired positions and stopped by the individual operation of the servo motors 90 to 96, the storage button of the console 72 is turned on. With this, the detected positions of rotation position sensors of the plurality of servo motors 90 to 96 at the stopped positions can be stored (taught) as a plurality of pieces of target position data constituting a target position data set. Then, an operation program can be created by setting the speed and acceleration for moving to the teaching point specified by the target position data set by program editing using the console 72.

After the operation program is created, the operation program is actually executed in the manual operation mode to form the coil spring W1. The program is edited so that the difference between the coil spring W1 and the specification falls within an allowable value. Specifically, for example, a desired target position data set is selected by the operation program, and desired target position data of the target position data set is changed by inputting a specific numerical value using the console 72. Then, program editing is performed such that the difference between the actually formed coil spring W1 and the specification falls within the allowable value. Additionally, another operation program for forming a coil spring W1 with a different coil diameter can be created by copying an existing operation program and then changing desired target position data to obtain a new target position data set, for example.

Figure 8:
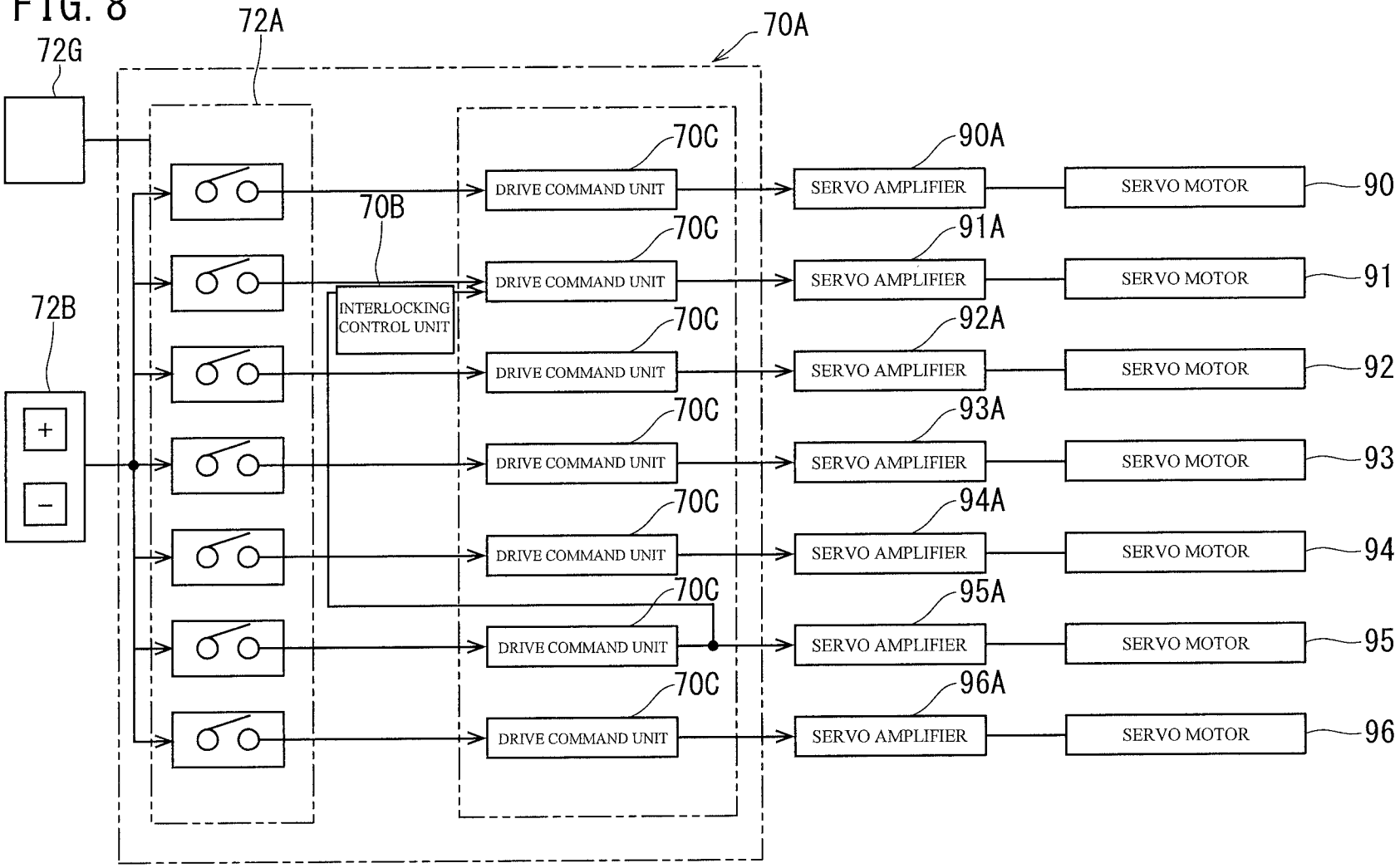
FIG. 8 is a block diagram of an individual drive control unit.
Figure 9:
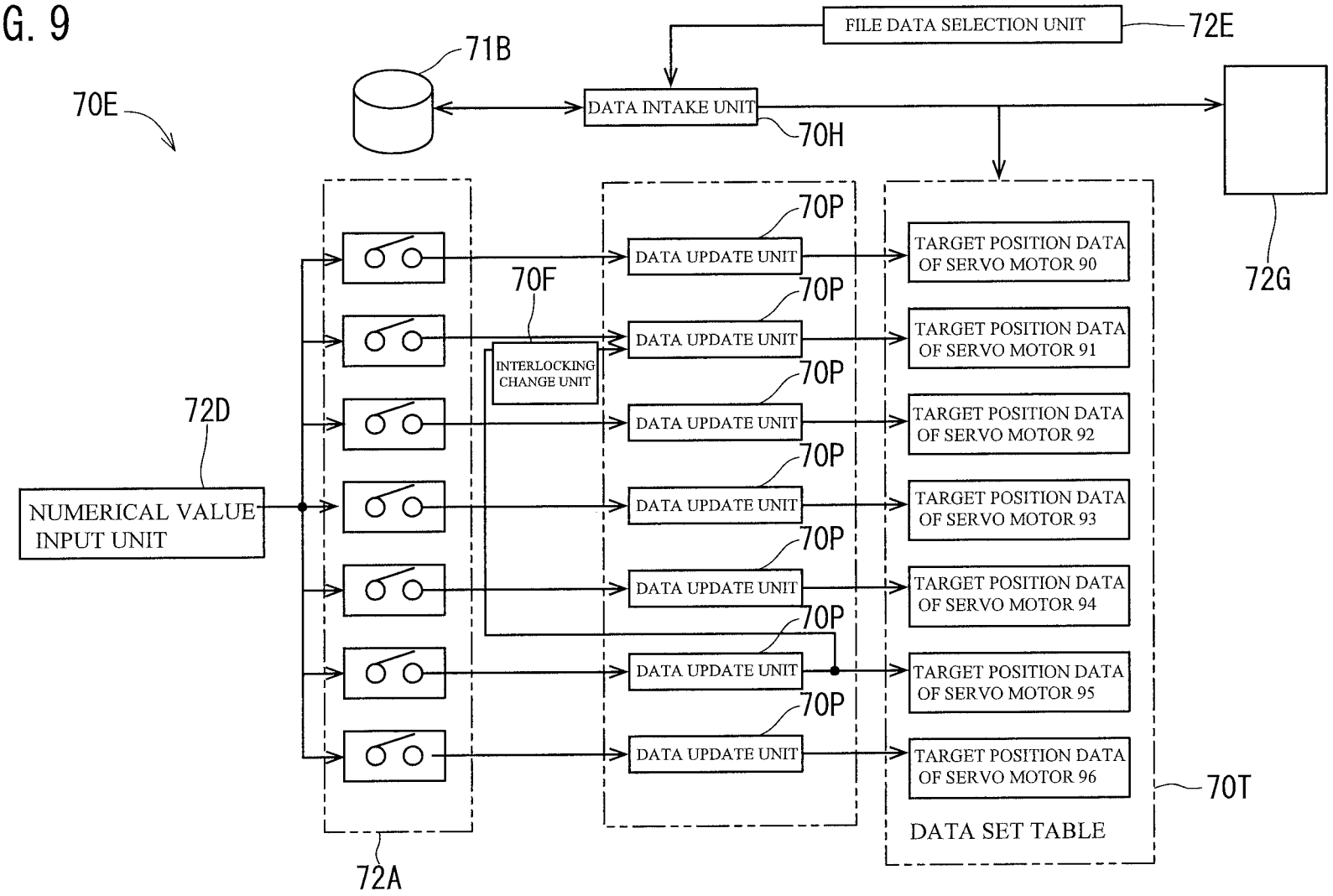
FIG. 9 is a block diagram of a program editing unit.

Here, as described above, when the servo motor 90 to 96 is individually operated, the controller 70 functions as an individual drive control unit 70A illustrated in the block diagram of FIG. 8, and when program editing is performed, the controller 70 functions as a program editing unit 70E illustrated in the block diagram of FIG. 9.

As illustrated in FIG. 8, in the individual drive control unit 70A, for example, when an any desired forming movable part is selected by the operation of a selective operation unit 72A of the console 72 and a movement operation button 72B of the console 72 for designating the operation direction is pressed, a drive command unit 70C drives the servo motor 90 to 96, so that the selected forming movable part moves at a predetermined speed set in advance in the designated direction while the movement operation button 72B is pressed. For example, when the pitch tool 33 is selected as the forming movable part and the servo motor 91 serving as the drive source of the pitch tool 33 is individually operated, the pitch tool 33 is selected by the selective operation unit 72A and the operation button 72B for moving upward or downward movement is pressed while viewing a monitor 72G provided in the console 72. Then, a command is given from the drive command unit 70C to the servo amplifier 91A so that the servo motor 91 is driven to move the pitch tool 33 upward together with the slider 53 of the first lifting mechanism 41 at a predetermined speed only while the movement operation button 72B is pressed. While the servo motor 91 for moving the pitch tool 33 is driven, the other servo motors 90 and 92 to 96 are maintained in a stopped state. The same applies to the case of individually operating the servo motors 90, 92, 93, 94, and 96 of other forming movable parts other than the servo motor 95 of the lifting base 15.

On the other hand, for example, when the servo motor 95 of the lifting base 15 is individually operated to change the vertical position of the cored bar 32, the operation itself of the servo motor 95 of the lifting base 15 is controlled in the same manner as when the servo motor 91 of the pitch tool 33 is individually operated. In addition, in order to prevent the pitch tool 33 from moving with respect to the fixing base 11 together with the lifting base 15, an interlocking control unit 70B included in the individual drive control unit 70A interlocks the servo motor 91 serving as the drive source of the pitch tool 33, with the servo motor 95 serving as the drive source of the lifting base 15. As a result, the pitch tool 33 moves with respect to the lifting base 15 at a predetermined speed in the direction opposite to the upward or downward movement of the lifting base 15.

That is, the interlocking control unit 70B of the present embodiment is configured to interlock the servo motors 91 and 95, so that the slider 53 of the first lifting mechanism 41 is not lifted and lowered with respect to the fixing base 11 along with lifting and lowering of the lifting base 15 with respect to the fixing base 11 when the servo motor 95 of the lifting base 15 is individually operated, and not to interlock the servo motors 91 and 95 when the servo motor 91 of the first lifting mechanism 41 is individually operated. Since the interlocking control unit 70B is provided, the spring forming machine 10 of the present embodiment can easily perform individual adjustment of the forming movable parts by the plurality of servo motors 90 to 96.

As described above, in the spring forming machine 10 of the present embodiment, the positions of the movable parts such as the forming tool 31 and the pitch tool 33 can be individually adjusted by the individual operation of the plurality of servo motors 90 to 95 which are drive sources thereof. Here, in the spring forming machine 10 of the present embodiment, the first lifting mechanism 41 that supports the pitch tool 33 is attached to the lifting base 15 that supports the cored bar 32. However, when the servo motor 95 of the lifting base 15 is individually operated, the servo motors 91 and 95 of the lifting base 15 and the first lifting mechanism 41 are interlocked, so that the slider 53 of the first lifting mechanism 15 is not lifted and lowered with respect to the fixing base 11 along with lifting and lowering of the lifting base 15 with respect to the fixing base 11. Hence, the conventional problem does not occur. Furthermore, when the servo motor 91 of the first lifting mechanism 41 is individually operated, the servo motors 91 and 95 of the lifting base 15 and the first lifting mechanism 41 are not interlocked. Hence, the problem that the position of the cored bar 32 is changed along with the change in the position of the pitch tool 33 does not occur. As a result, the spring forming machine 10 of the present embodiment can perform individual adjustment of the position of the movable parts by the plurality of servo motors 90 to 96 easily, compared to the conventional technology.

As illustrated in FIG. 9, in the program editing unit 70E, when an operation program and a desired target position data set included in the operation program are selected by the operation of a file data selection unit 72E of the console 72, for example, a data intake unit 70H takes the selected target position data set into a data set table 70T and displays a plurality of pieces of target position data included in the target position data set on the monitor 72G. Then, when the target position data of the servo motor 90 to 96 serving as a drive source of a desired forming movable part, is selected by the selective operation unit 72A and numerical data is input by a numerical value input unit 72D, the target position data is changed to the input numerical data by a data update unit 70P and stored in the storage unit 71B.

Here, when the target position data of the servo motors 90, 91, 92, 93, 94, and 96 of forming movable parts other than the servo motor 95 of the lifting base 15 is selected and changed, only the selected target position data is changed. On the other hand, when the target position data of the servo motor 95 of the lifting base 15 is selected and changed in order to change the vertical position of the cored bar 32, in addition to the change of the target position data of the servo motor 95, the change of the position of the lifting base 15 with respect to the fixing base 11 due to the change of the target position data of the servo motor 95 will change the position of the pitch tool 33 mounted on the lifting base 15 with respect to the fixing base 11. To avoid such a change in the position of the pitch tool 33, an interlocking change unit 70F changes the target position data of the servo motor 91 of the first lifting mechanism 41 in conjunction with the target position data of the servo motor 95 of the lifting base 15. Since the interlocking change unit 70F is provided, the spring forming machine 10 of the present embodiment facilitates editing work of the operation program.

Note that in the spring forming machine 10 of the present embodiment, the winding direction of the coil spring W1 can be reversed by disposing the forming tool 31 and the cored bar 32 below the wire feeding line L1, attaching the cutting tool 34 to the first lifting mechanism 41, and attaching the pitch tool 33 to the second lifting mechanism 42. This increases variations in the type of the coil spring W1 that can be formed. In a case where the cutting tool 34 is attached to the first lifting mechanism 41 and the pitch tool 33 is attached to the second lifting mechanism 42, the above-described control is performed with the lifting mechanism of reference numeral 42 to which the pitch tool 33 is attached serving as the "first lifting mechanism" and the lifting mechanism of reference numeral 41 to which the cutting tool 34 is attached serving as the "second lifting mechanism".

Second Embodiment

In a spring forming machine 10 of the present embodiment, in an operation program, origin position data is set for each forming movable part, and target position data of each forming movable part is specified by a displacement amount based on the origin position data. As a result, by changing any desired origin position data in a program editing unit 70E, the positions specified by all the target position data in the operation program based on the origin position data are changed at once. When the origin position data for a cored bar 32, which is the reference of the target position data of a servo motor 95 of a lifting base 15, is changed in order to change the vertical position of the cored bar 32, an interlocking change unit 70F changes the position data of the origin position for a pitch tool 33, so that the position of the pitch tool 33 with respect to a fixing base 11 does not change together with a slider 53 of a first lifting mechanism 41 due to the change in the position of the lifting base 15 with respect to the fixing base 11. As described above, in the spring forming machine 10 of the present embodiment, data processing of canceling the lifting and lowering of the slider 53 of the first lifting mechanism 41 due to the change of the target position data of the servo motor 95 of the lifting base 15 becomes easy.

Other Embodiments (1) While the spring forming machine 10 of the first embodiment includes the pair of forming tool slide mechanisms 40 for using the pair of forming tools 31, it is also conceivable to use only one forming tool 31 with only one forming tool slide mechanism 40.

(2) The mechanism for converting the rotational output of the servo motor into linear motion described in the first embodiment is not limited to the crank mechanism and the ball screw mechanism described above, and may be appropriately changed to a cam mechanism, a rack-and-pinion mechanism, or the like.

Note that, while specific examples of the technology included in the claims are disclosed in the present specification and drawings, the technology described in the claims is not limited to these specific examples, and includes those obtained by variously modifying and changing the specific examples, and also includes those obtained by singly extracting a part from the specific examples.

What is claimed is:

1. A spring forming machine, comprising:

a wire feeder that feeds a wire along a horizontal wire feeding line;

a forming tool that forms the wire into a coil spring surrounding a cored bar;

a pitch tool that enters a space between coils of the coil spring from one side in a vertical direction with respect to the coil spring and expands the space between the coils of the coil spring;

a cutting tool that approaches the wire from another side in the vertical direction and cuts the wire, thereby separating the formed coil spring from a remaining portion of the wire;

a forming tool slide mechanism including a slider to which the forming tool is fixed, the slider being supported to be linearly movable in a direction inclined with respect to the wire feeding line;

a first lifting mechanism including a slider to which the pitch tool is fixed, the slider being supported to be liftable on one side in the vertical direction with respect to the cored bar;

a second lifting mechanism including a slider to which the cutting tool is fixed, the slider being supported to be liftable on another side in the vertical direction with respect to the cored bar;

a fixing base to which the wire feeder and the forming tool slide mechanism are attached;

a lifting base that is liftably supported by the fixing base, and to which the cored bar, the first lifting mechanism, and the second lifting mechanism are attached;

a plurality of servo motors that are drive sources of the wire feeder, the forming tool slide mechanism, the first lifting mechanism, the second lifting mechanism, and the lifting base;

a controller that controls the plurality of servo motors;

an individual drive control unit that is provided in the controller and individually drives each of the servo motors corresponding to an operation of an operation unit; and an interlocking control unit that, when the servo motor of the lifting base is individually operated, interlocks the servo motors of the lifting base and the first lifting mechanism so that the slider of the first lifting mechanism is not lifted and lowered with respect to the fixing base by lifting and lowering of the lifting base with respect to the fixing base, and, when the servo motor of the first lifting mechanism is individually operated, does not interlock the servo motors of the lifting base and the first lifting mechanism.

2. The spring forming machine according to claim 1, further comprising:

a storage unit that stores an operation program including a plurality of target position data sets that are sets of target position data of the plurality of servo motors;

a program execution unit that is provided in the controller and executes the operation program to perform control such that rotation axes of the plurality of servo motors simultaneously reach positions of the plurality of pieces of target position data included in each of the target position data sets;

a program editing unit that is provided in the controller and individually changes the plurality of pieces of target position data included in the target position data set corresponding to an operation of the operation unit; and an interlocking change unit that, when the target position data of the servo motor of the lifting base is changed by the program editing unit, changes the target position data of the servo motor of the first lifting mechanism in conjunction with the target position data of the servo motor of the lifting base so that a position of the slider of the first lifting mechanism with respect to the fixing base does not change due to a change in a position of the lifting base with respect to the fixing base by the change, and, when the target position data of the servo motor of the first lifting mechanism is changed by the program editing unit, does not change the target position data of the servo motor of the lifting base in conjunction with the change.

3. The spring forming machine according to claim 2, wherein the target position data of the servo motor of the first lifting mechanism in the operation program is specified by a displacement amount based on position data of a preset pitch tool origin position, and when the target position data of the servo motor of the lifting base is changed by the program editing unit, the interlocking change unit changes the position data of the pitch tool origin position so that the position of the slider of the first lifting mechanism with respect to the fixing base does not change due to the change in the position of the lifting base with respect to the fixing base caused by the change of the target position data.

* * * * *